United States Patent [19]

Briner et al.

[11] 4,370,850

[45] Feb. 1, 1983

[54] ROVING FRAME AND A METHOD OF PACKAGING ROVING

[75] Inventors: Emil Briner; Peter Novak, both of Winterthur, Switzerland

[73] Assignee: Rieter Machine Works, Ltd., Winterthur, Switzerland

[21] Appl. No.: 191,302

[22] Filed: Sep. 26, 1980

[30] Foreign Application Priority Data

Sep. 28, 1979 [GB] United Kingdom ..... 7933785

[51] Int. Cl.[3] ..... D01H 7/50

[52] U.S. Cl. ..... 57/96; 57/93; 57/97

[58] Field of Search ..... 57/78, 80, 81, 83, 85, 57/92, 93, 96, 67, 264, 267, 269, 276, 278, 97

[56] References Cited

U.S. PATENT DOCUMENTS

| | | | |
|---|---|---|---|
| 3,015,203 | 1/1962 | Heiberg | 57/93 |
| 3,043,991 | 7/1962 | Schneider et al. | 57/81 X |
| 3,546,870 | 12/1970 | Schewe et al. | 57/278 X |
| 3,778,996 | 12/1973 | Olson et al. | 57/278 X |
| 3,841,074 | 10/1974 | Wachendorf et al. | 57/278 |
| 4,134,253 | 1/1979 | Handa et al. | 57/96 |
| 4,196,572 | 4/1980 | Hunt et al. | 57/96 |
| 4,254,615 | 3/1981 | Adolf et al. | 57/96 |

*Primary Examiner*—Donald Watkins

*Attorney, Agent, or Firm*—Kenyon & Kenyon

[57] ABSTRACT

Tension is reduced in the unwound length of roving remaining between the drafting mechanism and the package after the frame has been brought to a halt. This can be done by additional feed from the drafting mechanism after stopping of the other elements of the frame. A tension adjusting means is coupled into the drive to the rollers of the drafting mechanism to advance the mechanism the desired amount. The degree of feed may be different depending upon whether the stoppage is due to a break at one of a group of flyers, or to a doffing operation.

24 Claims, 3 Drawing Figures

ROVING FRAME AND A METHOD OF PACKAGING ROVING

This invention relates to a roving frame and a method of packaging roving. More particularly, this invention relates to a roving frame with an adjusting means for reducing tension in a delivered roving.

Heretofore, it has been known that all roving frames include three basic elements, namely a drafting mechanism for drafting sliver presented to the mechanism, means for supporting and rotating a bobbin upon which a package of roving is formed in use and a flyer which guides the roving into the package and can be rotated relative thereto so that some twist is inserted in the length of roving between the flyer and the drafting mechanism. During formation of roving from sliver, the drafting mechanism, flyer and bobbin supporting/rotating means (hereinafter "bobbin support") are driven in strictly controlled relation, usually by suitable respective gear transmissions from a common drive source e.g. electric motor. As the roving is drawn into a package by rotation of the package, there is clearly tension in the length of roving between the package and the drafting mechanism (hereinafter the "unwound roving length"). However, the degree of twist imparted to the roving is necessarily low to enable further drafting in the next process stage. The breaking strength of the roving is, therefore, also low. Breaks in the roving are thus quite common in the unwound roving length. Such breaks are particularly common during start up after a temporary shut down of the frame with a continuous unwound roving length remaining between the package and drafting mechanism. Such a shut down might occur during a normal break in operation or due to a roving or sliver break in one of a group of roving stations operated by a common drive system.

Accordingly, it is an object of the invention to reduce the number of roving breaks in a roving being processed on a roving frame.

It is another object of the invention to provide a roving frame which is operable with relatively few, if any, roving breaks following a temporary shut down.

It is another object of the invention to facilitate inclusion of an automatic doffer in a roving frame.

Briefly, the invention provides a roving frame and a method of packaging roving wherein the risk of roving breaks is minimized.

The roving frame is comprised of a drafting mechanism for delivering at least one roving, a spindle for mounting a bobbin thereon, a rotatable flyer for receiving the roving from the drafting mechanism and for winding the roving onto a bobbin on the spindle to form a roving package and a controllable tension adjusting means for producing tension in a continuous length of roving extending between the drafting mechanism and the package during stoppage of the drafting mechanism and the package.

The tension adjusting means can be actuated by a suitable actuating means e.g. upon stoppage of the drafting mechanism, or during a doffing operation and immediately prior to a start-up of the frame. A control system is also provided for starting the drafting mechanism, flyer and spindle. This control system is connected to the actuating means to energize the same in response to restarting of the frame.

In one embodiment where the frame has a main drive for driving the drafting mechanism, flyer and spindle the tension adjusting means is in the form of an auxiliary drive means for driving at least one of the drafting mechanism, flyer and spindle. Where the adjusting means is connected to the drafting mechanism, the adjusting means drives the mechanism an amount sufficient to over feed a length of roving therefrom relative to the rate of take-up by the package to reduce the tension in the delivered roving.

The roving frame may also have separate drive transmissions for driving each of the drafting mechanism, flyer and spindle. In this case, the tension adjusting means is connected to at least one of the drive transmissions in order to adjust at least one of the drafting mechanism, flyer and spindle. For example, where the drive transmission for the drafting mechanism has a drive receiving input, such as a shaft, one coupling is provided to couple the input to a main drive for operating the mechanism during roving production while a second coupling is provided to couple the input to the tension adjusting means for operating the mechanism during a tension adjustment. These couplings may be in the form of free wheel clutches. The three drive transmissions may also be connected in common to a main drive.

The method of the invention comprises the steps of delivering a length of roving from the drafting mechanism to the flyer, of rotating the flyer to wind the roving under tension onto a bobbin to form a roving package and of reducing the tension in the roving extending from the drafting mechanism to the package during stoppage of the mechanism and package. Tension adjustments may occur before or after the basic elements are brought fully to a halt. Preferably, the tension is reduced only after the roving is brought to a halt. In some cases, the tension is reduced immediately prior to a restart of the drafting mechanism or immediately prior to doffing.

The degree of tension reduction required will depend upon the circumstances and is best determined empirically. However, only a small degree of tension reduction will normally be sufficient to enable restart of roving production by the basic elements with the continuous unwound roving length which remains between the drafting mechanism and the package being taken up, unbroken, by the package. This small reduction in tension is sufficient to compensate for the increase in tension which is found in the unwound roving length due to the speed variations which occur during shut down and start up of the basic elements.

The roving frame can be used with an automatic doffing system for doffing completed packages. In this case, during doffing the roving is preferably broken between the flyer and the package simply by relative movement of these elements, leaving a tail of substantially predetermined length projecting from the flyer for take up by the next bobbin. If the original tension in the unwound roving length is maintained during doffing, reliable breaking of the roving in the required place becomes extremely difficult to ensure; breakage may occur at any weak spot along the unwound roving length. However, by suitably reducing tension in the unwound roving length, preferably to the extent of providing slack in the length of roving remaining between the drafting mechanism and the flyer, the "doffing break" can be made to occur reliably between the flyer and the package. This is so even when such a break occurs simply due to a relative movement of these elements, i.e. without the complication of a severing device to ensure a break at the required location.

These and other objects and advantages of the invention will become more apparent from the following detailed description taken in conjunction with the accompanying drawings in which.

Figure 1:
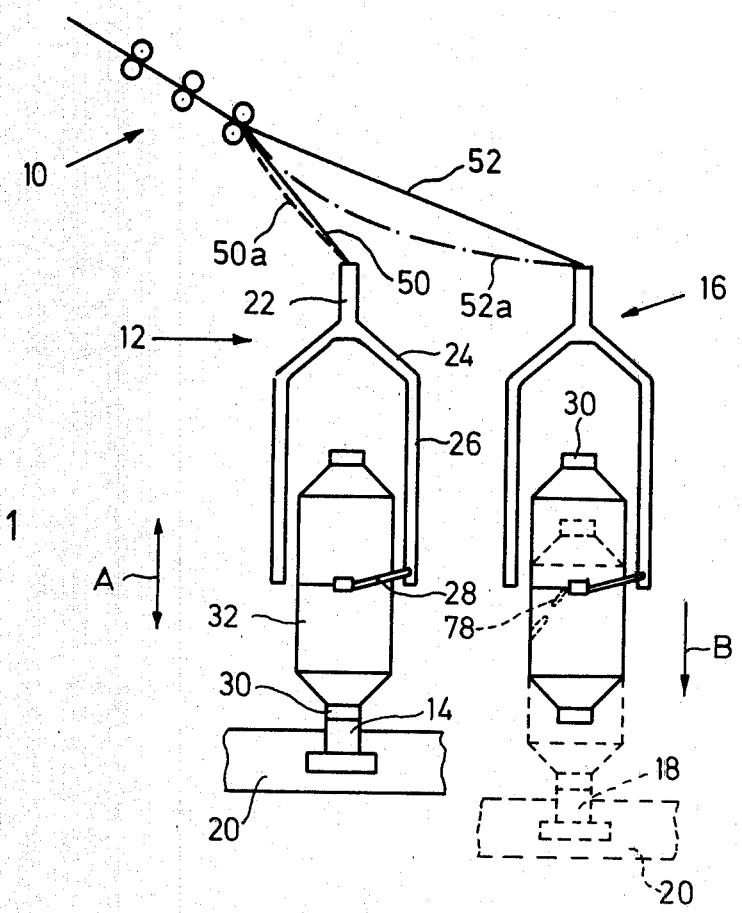
FIG. 1 illustrates a schematic view of a roving frame constructed in accordance with the invention.

Referring to FIG. 1, the roving frame is constructed of a multiplicity of "stations" only one of which is shown. This station includes a drafting mechanism 10, a pair of rotatable flyers 12, 16 and spindles 14, 18 disposed on vertical axes. The stations are arranged side by side so that the spindles form two parallel rows extending perpendicular to the plane of FIG. 1. All of these spindles 14, 18 are carried by a beam 20 which is reciprocal in a vertical direction by suitable means (not shown) as indicated by the double headed arrow A. The purpose of this reciprocation is well known and is briefly referred to below. The beam 20 carries a suitable drive transmission, for example in the form of a driven belt 20, by means of which the spindles can be rotated about their respective axes. As indicated, each spindle 14 carries a bobbin 30.

The drafting mechanism 10 comprises three pairs of rolls in a generally conventional arrangement which need not be further described.

Figure 2:
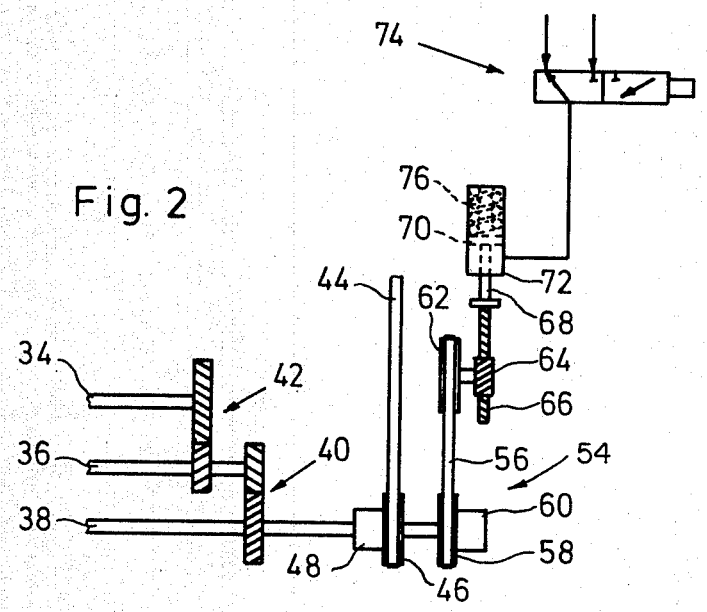
FIG. 2 illustrates a schematic view of a drive means for a part of the roving frame of FIG. 1 in accordance with the invention.

The flyers 12, 16 are of a type as described in Swiss Patent Application No 6377/79. As each is of the same construction, only one need be further described. To this end, the flyer 12 has a hollow shaft 22 and a yoke 24 with a hollow leg 26 leading to a guide 28. The roving 50 leaving the drafting mechanism 10 is fed to the flyer 12 and is directed down the interior of the hollow shaft 22, yoke 24 and leg 26 to be fed, via the guide 28, onto the bobbin 30 carried and rotated by the spindle 14 so that the roving is wound onto the bobbin 30 to form a package 32. The guide 28 remains at a fixed height during reciprocation of the beam 20 so that the roving package 32 is formed on the bobbin 30 in a desired shape in a manner which is well known. The flyer 12 meanwhile is rotated via the shaft 22 so that a degree of twist is imparted to the roving which is dependent upon the relation between the rotation of the flyer and the package. A suitable drive is provided for driving the drafting mechanism 10, flyers 12, 16 and spindles 14, 18. To this end, separate drive transmissions are connected between the main drive (not shown) and the respective drafting mechanism 10, flyers 12, 16 and spindles 14, 18. For example, as shown in FIG. 2, the three pairs of rolls of the drafting mechanism 10, i.e. the infeed, intermediate and delivery rolls, are driven by respective shafts 34, 36, 38. The shaft 38 which acts as a drive receiving input drives the shaft 36 via gears 40 while the shaft 36 drives the shaft 34 via gears 42. The shaft 38 is also selectively coupled with the main drive (not shown) over a belt 44 such as a toothed belt, a pulley 46 and a coupling formed by a free wheel clutch 48. As indicated, the belt 44 drives the pulley 46 and the pulley 46 is coupled to the shaft 38 via the clutch 48. The various transmissions for driving the drafting mechanism 10, flyers 12, 16 and spindles 14, 18 are driven off the common main drive via suitable gearing so as to operate in a carefully controlled relation to each other. Thus, in normal production of roving, each length of roving 50, 52 extends from the nip of the delivery rolls of the drafting mechanism 10 to the head of the hollow shaft 22 of the flyer 12, 16, down the shaft 22, yoke 24 and leg 26, along the guide 28 and to the lay-on point where the roving meets the bobbin 30 or package forming thereon. This is the "unwound" roving length. During running of the frame, the "unwound" roving length is under tension and is held taut between the delivery nip and the flyer, as indicated in full lines in FIG. 1. In the simplest case, the roving will remain in this condition throughout formation of a complete package and tension adjustment will be required only during doffing of the full package. This operation will be described later with reference to the right hand spindle and package shown in FIG. 1. In the more complicated case, there is a break in the normal operation, for example, termination of production at the end of a shift or shut down of all stations driven from a common source of motive power due to a sliver or roving break on one of them.

Assume, therefore, that the left hand spindle 14 shown in FIG. 1 has been brought to a halt with a partially completed package thereon. Since the basic elements of the frame are coupled, the flyer 12 and drafting mechanism 10 are also stationary. The unwound roving length is still continuous between the delivery nip and the package, and remains under tension, i.e. in the taut condition 50. If the station is now restarted, the tension conditions produced in this unwound roving length, due to speed variations during the deceleration and acceleration periods, too frequently place undue strain on the roving and break the roving.

In order to overcome this problem, the frame is provided with tension adjusting means 54 capable of slightly slackening the length of roving 50 between the delivery nip and the flyer. This is exaggerated in FIG. 1 for purposes of illustration, the slackened length being shown in dotted line at 50*a*, 52*a*. In practice, an increase of between 10 and 15 millimeters (mm) in the total length of the unwound roving length has been found adequate to compensate for the tension increase found during shut down and restart, and an increase in this total length of up to 20 millimeters (mm) should be ample for practical purposes. The station can then be restarted without additional precautions. In practice, the whole frame is started and stopped simultaneously, the drafting rolls extending the full length of the frame and being associated with each station therein.

The tension adjusting means is controllable so as to reduce the tension in the roving during stoppage of the drafting mchanism 10 and the package 32. As shown in FIG. 2, the tension adjusting means 54 is in the form of an auxiliary drive means which is connected to the drive to the drafting mechanism 10 in order to drive the mechanism 10 in amount sufficient to overfeed a length of roving therefrom and thus reduce the tension in the delivered roving. The adjustment can be provided after roving production has been brought to a halt. As shown, the auxiliary drive means includes a drive belt 56, such as a toothed belt, which drives a pulley 58 which is coupled to the shaft 38 via a coupling 60 such as a free wheel clutch of the same type as clutch 48. The belt 56 is driven by a pulley 62 which, in turn, is driven by an actuating means.

As indicated, the actuating means serves to actuate the tension adjusting means 54 at at least one predetermined stage of operation of the roving frame. As shown, the actuating means includes a pinion 64 which is connected for rotation with the pulley 62, a rack 66 which meshes with the pinion 64 and a pneumatically operable piston and cylinder unit for reciprocating the rack 66. As indicated, the piston and cylinder unit includes a piston 70 which is connected to the rack 66 via a connecting rod 68 and a cylinder 72 which is subdivided by the piston 70 into two chambers. One chamber of the cylinder 72 is pneumatically pressurable via a control valve 74 while the second chamber houses a compression spring 76. The control valve 74 permits the first chamber to be exhausted when the valve is no longer operated. As indicated, the spring 76 serves to bias the piston 70 outwardly of the cylinder 72.

Each free wheel clutch 48, 60 includes a ring (not shown) which is driven by a respective pulley 46, 58 and a ring (not shown) which is coupled with the shaft 38. When the first ring is driven in a forward direction, the second ring is driven thereby in the same direction. However, when the first ring is driven in the reverse direction, there is no effect on the second ring due to a free wheel connection between the rings.

During normal operation, i.e. during roving production, the shaft 38 is driven forward via the clutch 48 from the pulley 46 and belt 44. At this time, the cylinder 72 is unpressurized and the piston 70 is in a full forward position under the influence of the spring 76. The pinion 64 does not rotate and, therefore, the belt 56 holds the pulley 58 stationary. Clutch 60 is, thus, in the free wheel condition.

A suitable control system is provided for sensing stoppage of the drafting mechanism 10, flyer 12, 16 and spindle 14, 18. The control system is connected to the actuating means, i.e. the valve 74, in order to energize the valve 74 during the stoppage. This control system may be of an electrical type. Thus, if the main drive is stopped, the electrical control system senses this stoppage and energizes the valve 74 to pressurize the cylinder 72. The piston 70 is then retracted against the bias of the spring 76 and the rack 66 rotates the pinion 64 to cause rotation of the pulley 58 in the forward direction. The clutch 60 couples this rotation to the shaft 38 while the clutch 48 is in the free wheel condition with the inner ring thereof rotating with the shaft 38 and the outer ring being held by the main drive. The amount of movement of the piston 70 and, hence, of the shafts 38, 36, 34 and hence, the amount of slackening of the unwound roving length is adjusted as desired by adjusting the pressurization of the cylinder 72.

Pressurization the cylinder 72 is maintained until the roving frame is restarted. At this time, operation of the valve 74 is cancelled and the cylinder 72 is exhausted. The piston 70 then returns to the full forward position so that the pulley 58 is rotated in the reverse direction with the clutch 60 freewheeling.

The basic tension adjustment operation is thus completed. However, the tension adjustment means 54 may also be used during a doffing operation which will now be described with reference to the right hand spindle as shown in FIG. 1. To enable doffing, the frame may be constructed in a similar fashion to that as described in Swiss Patent Application No. 6420/79.

At the start of a doffing cycle, the basic elements of the roving frame are all brought to a halt. During doffing, the beam 20 is moved downwards in the direction indicated by the arrow B. Since the drafting mechanism 10 is not supplying roving, the length of roving between the guide 28 and the lay on point on the package must stretch. Desirably, this length of roving breaks to leave a tail 78 hanging from the guide 28. This tail can be taken up automatically when the next bobbin is placed over the spindle 18. However, in practice, if the length of roving 52 between the delivery nip of the mechanism 10 and the head of the flyer 16 is maintained taut, as shown in full lines, the tension increase caused by the downward movement of the package immediately passes back along the unwound roving length. Thus, the roving may break anywhere along its length.

In accordance with the invention, when the basic elements of the roving frame are stationary at the start of a doffing cycle, the valve 74 is once again operated to pressurize cylinder 72 and feed forward some roving to slacken the unwound roving length. In this case, a greater degree of slackening is desirable, as indicated by the chain dotted loop 52*a* in FIG. 1, and the pressurization of cylinder 74 for the doffing operation must be adjusted accordingly. Normally, however, a lengthening of the unwound roving length of up to 100 millimeters (mm) (preferably 60–70 mm) will be found suitable. Now, as the package is moved downwards, some of the slack in the roving between the delivery nip and the flyer head is taken up, but the required break occurs reliably in the region of the lay on point where the roving tends to slide on the surface of the package, and the tail 78 is therefore reliably obtained. The return of the piston 70 after completion of doffing is as before.

Figure 3:
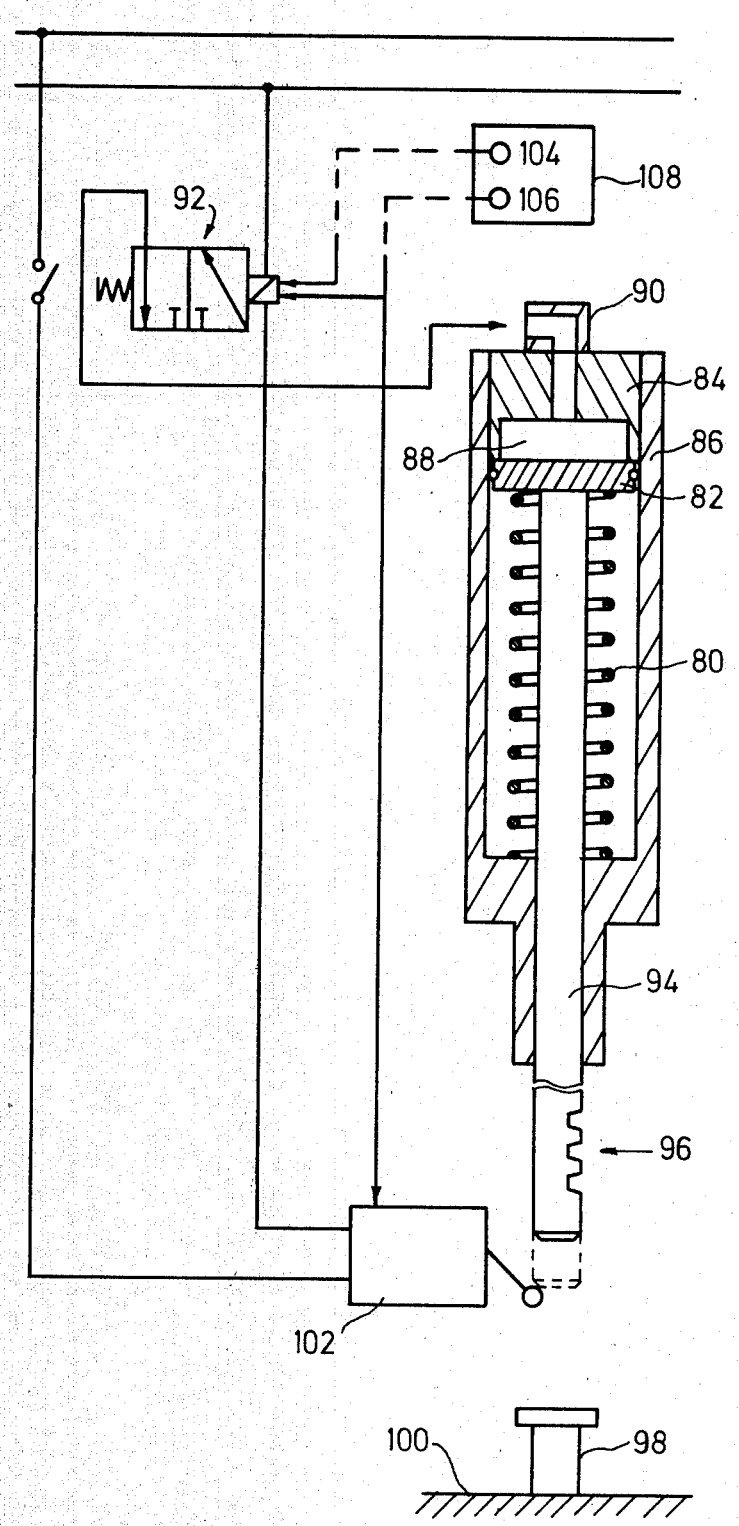
FIG. 3 illustrates a further embodiment of an actuating means and control system for actuating a tension adjusting means in accordance with the invention.

Referring to FIG. 3, the actuating means and control system may be of other suitable construction. For example, the actuating means may have a piston and cylinder unit wherein a spring 80 biases a piston 82 to a "retracted position", that is an upward direction, as viewed, against a stop provided on an end cap 84 of a cylinder 86. An upper chamber 88 of the cylinder 86 can be pressurized by a control system via a nipple 90 on the end cap 84 and a valve 92 of the control system for controlling feed of pressure fluid (pneumatic or hydraulic) to the nipple 90. In addition, the piston 82 is connected to a piston rod 94 which is formed with integral teeth 96 for operating an auxiliary drive means as described above. There is no physical obstruction to movement of the rod 94 in response to pressurization of chamber 88 until the free end of the rod 94 engages a stop 98 which is screw threaded in a support 100 provided on the machine frame. The stop 98 is adjustable by means of the screw threads to enable an accurate setting of the maximum permitted stroke of the piston 82. This setting determines the degree of relaxation of the roving produced prior to a doff.

In moving between the retracted position, shown in full lines in FIG. 3, and a fully extended position, engaging stop 98, the rod 94 engages an operating portion of a microswitch 102 and alters the condition of the switch 102. The position of the switch 102 is adjustable longitudinally of the axis of the rod 94. The switch 102 is connected in an electrical circuit of the control system which includes an operating device for the valve 92, so that the condition of the valve 92 can be reversed when the switch 102 is operated. The valve operating device is further coupled with two buttons 104, 106 respectively, on a control panel diagrammatically indicated at 108, and one button 106 is further coupled with the microswitch 102 for a purpose to be described.

Button 104 is a start button for starting operation of the machine as a whole and operates via suitable electrical interlocks (not shown) upon the main drives as well as upon the auxiliary drive means. Pressing of the button 104 first causes pressurization of the chamber 88 via valve 92 until the rod 96 operates the switch 102 which reverses the condition of the valve 92. In travelling to a partially extended position, shown in dotted lines in FIG. 3, the rod 94 via the teeth 96 operates the auxiliary drive means (not shown) to produce the relatively low degree of relaxation indicated at 50*a* in FIG. 1. The interlocks then permit start up of the main drives while the rod 94 and piston 82 return to their retracted positions.

Button 106 is a start button for starting operation of the doffing mechanism (not shown) to which the button 106 is also electrically connected via suitable interlocks. Pressing of the button 106 first causes pressurization of the chamber 88 and simultaneous overriding of the switch 102. When the switch 102 is operated, the switch 102 does not therefore reverse the valve 92, so that the rod 94 continues to the fully extended position. The teeth 96 therefore operate the auxiliary drive means to produce the larger degree of relaxation shown at 52*a* in FIG. 1. The interlocks then permit the doff cycle proper to commence and pressurization of the chamber 88 is cancelled upon completion of the doff cycle.

The invention is not limited to details of the illustrated embodiment. The auxiliary drive means 54 can be replaced by any selectively operable means for producing a small rotation of the shaft 38. Even if the belt drive and free wheel clutch of the auxiliary drive means 54 is retained, the operating system therefor can be altered. For example only, the pneumatically driven devices shown in FIGS. 2 and 3 could be replaced by a motor selectively connectable to the pulley 62 via a clutch. Alternatively, "overfeed" of sliver can be replaced, or assisted, by reverse rotation of the package and/or by forward movement of the flyer. However, neither of these latter possibilities is thought desirable because of the need for complicated couplings in the spindle/flyer drives. In yet a further alternative, the auxiliary drive means can be eliminated altogether, and the main drive adjusted to enable selective operation of one or more of the basic elements to produce the required tension adjustment. For example, it is common practice to vary the speed of rotation of the spindle as the package diameter increases and a suitable speed varying device is built into the main drive transmission for this purpose. The speed varying device may be operable to "overslow" the package rotation speed just before the elements come to a halt, so that the package does not take up as much as normal of the delivered roving. However, this also is undesirable in that the control system required becomes substantially complicated. For the same reason, it is preferable not to try to integrate the tension adjustment movements (even when caused by an auxiliary drive) with the normal operating movements. The simplest control is obtained when the normal operating system is allowed to reach a complete halt, and the auxiliary drive means is thereafter initiated to adjust tension, preferably, but not essentially, immediately prior to restart.

Alternative control systems to those illustrated and described above are also possible. Preferably, initiation of relaxation operations, whether before a doff or otherwise, is effected immediately prior to the start of the desired machine operation. This can be by means of a press button as described or by any other initiation function. The mechanical switch 102 and stop 98 described above could be replaced by time relays triggered by appropriate input signals.

The invention is not limited to the amounts of slackening discussed above. In general, apart from the undesirable formation of large roving loops likely to snag on adjacent equipment, there is no upper limit to the slackening permissible since the machine will automatically take up the excess upon restart.

In the preferred arrangement, there is a single main drive motor for the whole roving frame. From this main motor, a first drive transmission drives the drafting mechanism which is common to all stations as described above. A second drive transmission drives all the flyers, for example via a driven belt co-operating with suitable elements (not shown) on the shafts 22 of the flyers and rotatably mounted in a suitable bearing structure in the frame. A third drive transmission drives all the bobbin spindles via the drive arrangement in the beam 20, as described above. Each transmission includes suitable gearing to ensure that the elements driven thereby operate in desired relation to each other. In addition, at least the spindle drive transmission includes speed varying means to enable a controlled change in the speed of rotation of the spindles during formation of a package, so that sliver delivered at constant speed from the drafting mechanism is taken up at a corresponding speed despite increase in package diameter. A sub-transmission, branching from the spindle transmission, may drive the beam 20, and an additional motor may be included if necessary to move the beam (with the spindles thereon) during the doffing cycle.

Although preferred, the above described drive system is not essential. The spindles could be grouped with respective drives for the spindle groups, but each group would then also need its own drafting mechanism and flyer drive.

What is claimed is:

1. A roving frame comprising:

a drafting mechanism for delivering at least one roving;

a spindle for mounting a bobbin thereon;

a rotatable flyer for receiving the roving from said drafting mechanism and for winding the roving onto a bobbin on said spindle to form a roving package; and a controllable tension adjusting means for reducing tension in a continuous length of roving which extends between said drafting mechanism and the package during stoppage of said drafting mechanism and the package at an intermediate stage of a winding operation.

2. A roving frame as set forth in claim 1 which further comprises an actuating means for actuating said tension adjusting means during a restarting sequence for restarting a normal winding operation after said stoppage at said intermediate stage.

3. A roving frame as set forth in claim 2 which further comprises a control system for starting said drafting mechanism, flyer and spindle, said control system being connected to said actuating means to energize said actuating means in response to operation of said control system.

4. A roving frame as set forth in claim 1 which further comprises a main drive for driving said drafting mechanism, said flyer and said spindle and wherein said tension adjusting means is an auxiliary drive means for driving at least one of said drafting mechanism, said flyer and said spindle.

5. A roving frame as set forth in claim 1 wherein said tension adjusting means is connected to said drafting mechanism to drive said mechanism an amount sufficient to over feed a length of roving therefrom to reduce the tension in the delivered roving.

6. A roving frame as set forth in claim 1 wherein said drafting mechanism is adapted to deliver a plurality of rovings to respective spindles each of which has a respective flyer associated therewith, said frame further comprising an actuating means for actuating said tension adjusting means and a control system for sensing stoppage of said drafting mechanism, flyer and spindle, said control system being connected to said actuating means prior to restarting of said drafting mechanism after said stoppage.

7. A roving frame as set forth in claim 1 wherein said drafting mechanism is adapted to deliver a plurality of rovings to respective spindles of a group of spindles each of which has a respective flyer associated therewith, said frame further comprising a first drive transmission for driving said drafting mechanism, a second drive transmission for driving said flyers, and a third drive transmission for driving said spindles and wherein said tension adjusting means is connected to at least one of said drive transmissions to adjust at least one of said drafting mechanism, flyer group and spindle group.

8. A roving frame as set forth in claim 7 wherein said tension adjusting means is connected to said first drive transmission to adjust said drafting mechanism relative to said flyer and said spindle.

9. A roving frame as set forth in claim 8 which further comprises a main drive and wherein said first drive transmission includes a drive receiving input for driving said mechanism, a first coupling selectively coupling said input with said main drive and a second coupling selectively coupling said input with said tension adjusting means.

10. A roving frame as set forth in claim 9 wherein said input is a shaft and each coupling is a free wheel clutch.

11. A roving frame as set forth in claim 7 which further comprises a main drive connected in common to said first drive transmission, said second drive transmission and said third drive transmission.

12. A method of packaging roving which comprises steps of:

delivering a length of roving from a drafting mechanism to a flyer;

rotating the flyer to wind the delivered roving under tension onto a bobbin to form a roving package during a normal winding operation;

stopping the drafting mechanism and the package;

subsequently restarting the drafting mechanism and the package to continue winding of further roving into the package; and reducing the tension in the roving which extends from the drafting mechanism to the package during said stoppage and restarting of the drafting mechanism and the package.

13. A method as set forth in claim 12 wherein the tension is reduced only after the roving is brought to a halt.

14. A method as set forth in claim 13 wherein the tension is reduced immediately prior to a restart of the drafting mechanism.

15. A method as set forth in claim 13 wherein the tension is also reduced immediately prior to doffing said package.

16. A method as set forth in claim 15 wherein the degree of tension reduction is substantially higher immediately prior to doffing than upon other stoppages.

17. A roving frame as set forth in claim 1 wherein said tension adjusting means is additionally operable at the start of a doffing cycle with said drafting mechanism and the package being stopped to reduce tension in a continuous length of roving which extends between said drafting mechanism and a completed package.

18. A roving frame as set forth in claim 17 further comprising an actuator for activating said tension adjusting means and a control system for controlling a doffing operation, said control system being arranged to operate said actuator prior to initiating said doffing operation.

19. A roving frame as claimed in claim 18 wherein said actuator is operable in a first mode to produce a relatively small reduction in tension during stoppage at said intermediate stage, and is operable in a second mode to produce a relatively large reduction in tension during stoppage immediately prior to doffing.

20. A roving frame as set forth in claim 1 which further comprises a control system for causing operation of said tension adjusting means at said intermediate stage.

21. A roving frame comprising a drafting mechanism for delivering at least one roving, a spindle for mounting a bobbin thereon, a rotatable flyer for receiving the roving from said drafting mechanism and for winding the roving onto a bobbin on said spindle to form a roving package, means for causing relative movement of said flyer and spindle to cause a roving break between said flyer and the completed package prior to removal of the completed package, and a controllable tension adjusting means operable prior to said means for causing relative movement of the flyer and spindle for reducing tension in a continuous length of roving which extends between said drafting mechanism and the completed package.

22. A roving frame comprising a drafting mechanism for delivering a plurality of rovings, a group of spindles for mounting respective bobbins thereon, a corresponding group of flyers for receiving respective rovings from said drafting mechanism and for winding the rovings onto said bobbins to form roving packages, a first drive transmission for driving said mechanism, a second drive transmission for driving said flyers, a third drive transmission for driving said spindles, a main drive for driving said transmissions, and an auxiliary drive means for driving at least one of said drive transmissions to adjust at least one of said drafting mechanism, flyer group and spindle group to reduce tension in continuous lengths of roving which extend between said drafting mechanism and the packages during stoppage of said drafting mechanism and the packages.

23. A roving frame comprising:

a drafting mechanism for delivering at least one roving;

a spindle for mounting a bobbin thereon;

a rotatable flyer for receiving the roving from said drafting mechanism and for winding the roving onto a bobbin on said spindle to form a roving package; and a controllable tension adjusting means connected to said drafting mechanism to drive said mechanism an amount sufficient to over feed a length of roving therefrom to reduce the tension in a continuous length of roving extending between said drafting mechanism and the package in response to stoppage of said drafting mechanism and the package.

24. A roving frame comprising:

a drafting mechanism for delivering at least one roving;

a first drive transmission for driving said mechanism;

a spindle for mounting a bobbin thereon;

a second drive transmission for driving said spindle;

a rotatable flyer for receiving the roving from said drafting mechanism and for winding the roving onto a bobbin on said spindle to form a roving package;

a third drive transmission for driving said flyer; and a controllable tension adjusting means for reducing tension in a continuous length of roving extending between said drafting mechanism and the package in response to stoppage of said drafting mechanism and the package, said tension adjusting means being connected to said first drive transmission to adjust said drafting mechanism relative to said flyer and said spindle.

* * * * *